US009366061B2

(12) United States Patent
Kwon

(10) Patent No.: US 9,366,061 B2
(45) Date of Patent: Jun. 14, 2016

(54) DRAW-OUT HANDLE OF TAILGATE

(75) Inventor: Young Jin Kwon, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 113 days.

(21) Appl. No.: 12/944,445

(22) Filed: Nov. 11, 2010

(65) Prior Publication Data

US 2012/0049544 A1 Mar. 1, 2012

(30) Foreign Application Priority Data

Aug. 31, 2010 (KR) ..... 10-2010-0084497

(51) Int. Cl.
*E05B 3/00* (2006.01)
*E05B 85/10* (2014.01)
*E05B 81/06* (2014.01)

(52) U.S. Cl.
CPC ..... *E05B 85/107* (2013.01); *E05B 81/06* (2013.01); *E05B 85/103* (2013.01); *Y10T 292/57* (2015.04)

(58) Field of Classification Search
CPC ..... E05B 81/06; E05B 85/103; E05B 85/107
USPC ..... 292/336.3, 144, 170; 296/16
See application file for complete search history.

(56) References Cited

U.S. PATENT DOCUMENTS 176,930 A * 5/1876 Collins ..... 292/336.3
226,682 A * 4/1880 Sparks ..... 292/336.3
276,325 A * 4/1883 Andrews ..... 292/336.3
287,039 A * 10/1883 Lyons ..... 292/336.3
5,226,032 A * 7/1993 Ikedo et al. ..... 369/30.92
5,530,990 A * 7/1996 Chen ..... 16/113.1
5,743,575 A * 4/1998 McFarland ..... 292/336.3
6,276,743 B1 * 8/2001 Jyawook et al. ..... 296/155
6,416,115 B2 * 7/2002 Ader et al. ..... 296/146.8
6,854,781 B2 * 2/2005 Roach ..... 296/57.1
7,070,226 B2 * 7/2006 Cleland et al. ..... 296/146.8
7,145,436 B2 * 12/2006 Ichikawa et al. ..... 340/5.72

(Continued)

FOREIGN PATENT DOCUMENTS

JP 63-7056 U 1/1988
JP 63-115921 U 7/1988

(Continued)

OTHER PUBLICATIONS

Pmb600, Mercedes-Benz S-class Trunk Closer, Youtube video uploaded Oct. 23, 2006, http://www.youtube.com/watch?v=1yLgf0C-WZw&noredirect=1.*

(Continued)

*Primary Examiner* — Kristina Fulton
*Assistant Examiner* — Thomas Neubauer
(74) *Attorney, Agent, or Firm* — Morgan, Lewis & Bockius LLP

(57) ABSTRACT

A draw-out handle of a tailgate is a tailgate handle pushed by a user is drawn out by the operation of a motor and the tailgate is opened and closed using the drawn-out tailgate handle. For this purpose, a draw-out handle of a tailgate includes a slidably movable tailgate handle, a motor unit for moving the tailgate to be drawn out or returned, a handle operation detection unit for detecting the operation of the tailgate handle pushed by a user, and/or a body control module (BCM) for drawing out the tailgate handle and unlocking a latch unit when receiving a handle operation signal of the handle operation detection unit.

14 Claims, 7 Drawing Sheets

(56) References Cited

U.S. PATENT DOCUMENTS

| | | | | |
|---|---|---|---|---|
| D549,075 | S * | 8/2007 | Jackson, Jr. | D8/331 |
| 7,299,480 | B2 * | 11/2007 | Tokunaga | 720/606 |
| 7,375,299 | B1 | 5/2008 | Pudney | |
| 8,052,188 | B2 * | 11/2011 | Chernoff et al. | 296/1.02 |
| 8,585,118 | B2 * | 11/2013 | Kileen | 296/96.17 |
| 8,684,435 | B1 * | 4/2014 | Lee | 296/1.02 |
| 2005/0127685 | A1 * | 6/2005 | Spurr et al. | 292/201 |
| 2006/0022630 | A1 * | 2/2006 | Spurr et al. | 318/650 |
| 2007/0034629 | A1 * | 2/2007 | Mazzarolo | 220/254.3 |
| 2008/0163555 | A1 * | 7/2008 | Thomas et al. | 49/460 |
| 2009/0079207 | A1 * | 3/2009 | Manzhura et al. | 292/336.3 |
| 2009/0309971 | A1 * | 12/2009 | Schuetz | 348/148 |
| 2011/0148575 | A1 * | 6/2011 | Sobecki et al. | 340/5.64 |

FOREIGN PATENT DOCUMENTS

| | | | |
|---|---|---|---|
| JP | 1-223285 | A | 9/1989 |
| JP | 2-38216 | U | 3/1990 |
| JP | 3-15959 | U | 2/1991 |
| JP | 6-191279 | A | 7/1994 |
| JP | 2001-40913 | A | 2/2001 |
| JP | 2003-276440 | A | 9/2003 |
| JP | 4445416 | B2 | 1/2010 |
| JP | 2010-159605 | A | 7/2010 |
| KR | 10-2006-0038213 | A | 5/2006 |
| KR | 10-0757150 | B1 | 9/2007 |
| KR | 10-0783533 | B1 | 12/2007 |
| KR | 10-2008-0023526 | A | 3/2008 |

OTHER PUBLICATIONS

AlbertDigital, Tesla Model S Walk Around and Features, Youtube video uploaded Apr. 11, 2009, http://www.youtube.com/watch?v=T_9JUvb7eYU.*

* cited by examiner

DRAW-OUT HANDLE OF TAILGATE

CROSS-REFERENCE TO RELATED APPLICATION

This application claims under 35 U.S.C. §119(a) the benefit of Korean Patent Application No. 10-2010-0084497 filed Aug. 31, 2010, the entire contents of which are incorporated herein for all purposes by this reference.

BACKGROUND

1. Technical Field

The present disclosure relates to an exterior draw-out handle of a tailgate. More particularly, it relates to an exterior draw-out handle of a tailgate, in which a tailgate handle pushed by a user is drawn out by the operation of a motor and the tailgate is opened and closed using the drawn-out tailgate handle.

2. Background Art

According to the recent demand for vehicles, the majority of vehicles sold are recreational vehicles (RVs) and multi-purpose vehicles (MPVs), and consumers are also showing increasing interest in such RVs and MPVs.

Typically, the multi-purpose vehicle is equipped with a tailgate at the rear of the vehicle, and the tailgate includes an outside handle and an inside handle for opening and closing the tailgate.

FIG. 1 shows a conventional outside handle of a tailgate.

As shown in FIG. 1, the conventional outside handle of the tailgate includes a switch handle (not shown) provided inside a housing 2 mounted on a tailgate panel 1, and a logo portion 4 is integrally formed on the front surface of the housing 2 to show a logo of a manufacturer.

According to such a conventional outside handle of the tailgate, when the switch handle is pulled through a hand insertion space of the housing 2, a latch unit (not shown) is manipulated such that the tailgate is opened.

However, the conventional outside handle of the tailgate shown in FIG. 1 has the problem that the hand insertion space of the housing is exposed to the outside of the tailgate, which results in deterioration of appearance.

The information disclosed in this background section is only for enhancement of understanding of the general background of the invention and should not be taken as an acknowledgement or any form of suggestion that this information forms the prior art already known to a person skilled in the art.

SUMMARY OF THE DISCLOSURE

The present invention has been made in an effort to solve the above-described problems associated with prior art. Accordingly, the present invention provides an exterior draw-out handle of a tailgate, which is configured such that a tailgate handle integrally formed with a logo of a manufacturer is drawn out by a motor unit operated by a pushing operation, thereby facilitating the opening and closing of the tailgate and improving its appearance.

In one aspect, the present invention provides an exterior draw-out handle of a tailgate, including a slidably movable tailgate handle, a motor unit for moving the tailgate to be drawn out or returned, a handle operation detection unit for detecting the operation of the tailgate handle pushed by a user, and a body control module (BCM) for drawing out the tailgate handle and, at the same time, unlocking a latch unit when receiving a handle operation signal of the handle operation detection unit.

The draw-out handle may further include a housing into which the tailgate handle is inserted, and a handle cover assembled to the housing and fixedly installed on an outside panel of the tailgate.

The handle operation detection unit may include a micro switch closed by the pushed tailgate handle and a wiring for transmitting the handle operation signal to the BCM when the micro switch is closed.

The housing may include an upper housing and a lower housing, the upper housing including a guide rail for guiding movement of the tailgate handle.

The tailgate handle may further include a damper for reducing the drawing-out and returning speed of the tailgate handle.

The tailgate handle may further include a handle gear rail provided at the bottom of the tailgate handle and formed into a gear shape matching with a motor gear of the motor unit.

The tailgate handle may further include a pair of gear guardrails provided at the bottom of the tailgate handle to support the motor gear to be located on the handle gear rail.

The tailgate handle may further include a logo portion integrally formed with a logo of a manufacturer on the front of tailgate handle.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
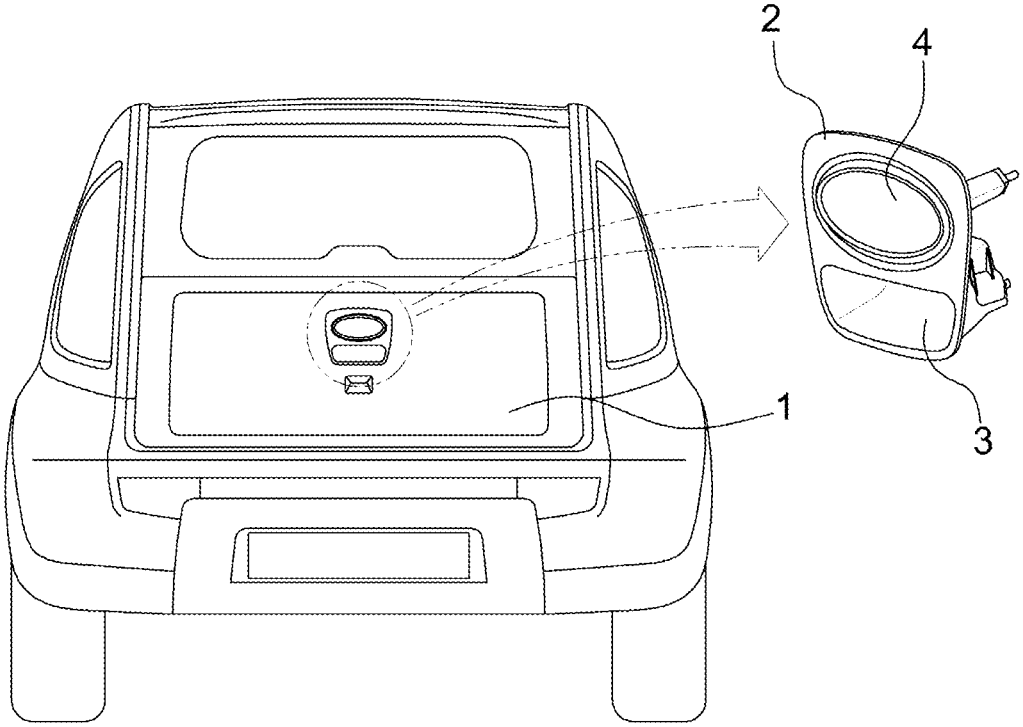
FIG. 1 is a diagram showing a conventional outside handle of a tailgate.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The present provides an exterior draw-out handle of a tailgate configured in such a manner that when a tailgate handle 300 integrally formed with a logo portion 340 is pushed by a user, a contact point 420 of a micro switch 400 provided in a housing 200 is closed, and thus power is applied to a motor unit 500 connected to the tailgate handle 300 such that the tailgate handle 300 is drawn out to the rear of a vehicle and, at the same time, a latch unit (not shown) is unlocked such that a lower end of the tailgate handle 300 is exposed to the outside.

The draw-out handle of the tailgate according to the present invention includes a handle casing or cover 100 fixedly provided on a tailgate panel 10, in detail, on an outside panel of the tailgate and a housing 200 fixedly assembled on the rear surface of the handle cover 100.

The handle cover 100 has an oval shape in which the center is opened, an assembly portion 130 and 140 for assembly with the outside panel of the tailgate and the housing 200 is provided on the rear surface of the handle cover 100, and a groove portion 110 for creating a space for backward movement of the tailgate handle 300 (pushed to the front of the vehicle by a pushing operation of a user) is provided at a predetermined depth on the front surface of the handle cover 100.

Figure 2A:
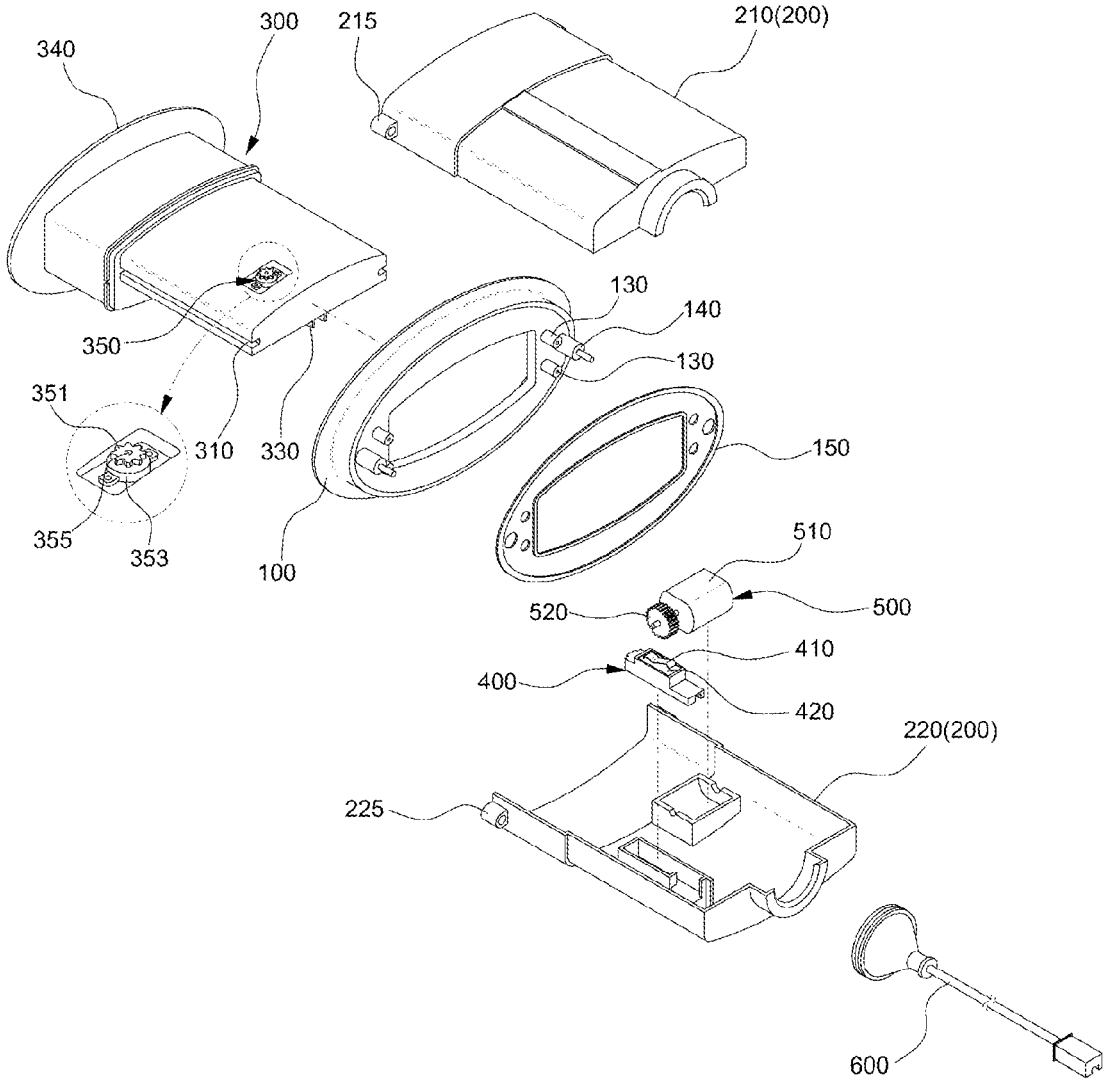
FIGS. 2A and 2B are exploded perspective views showing an exemplary exterior draw-out handle of a tailgate in accordance with the present invention.
Figure 2B:
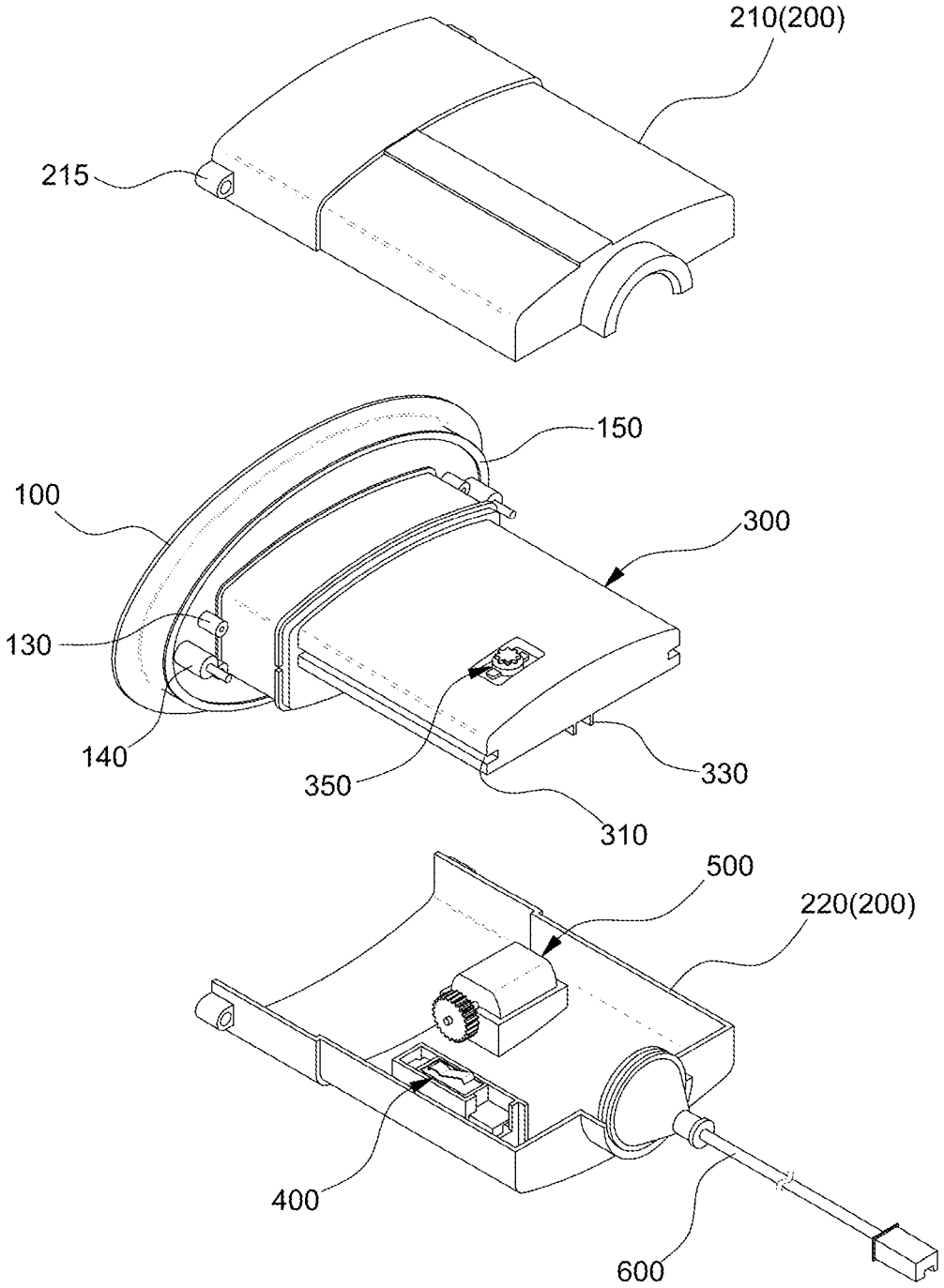
Figure 3:
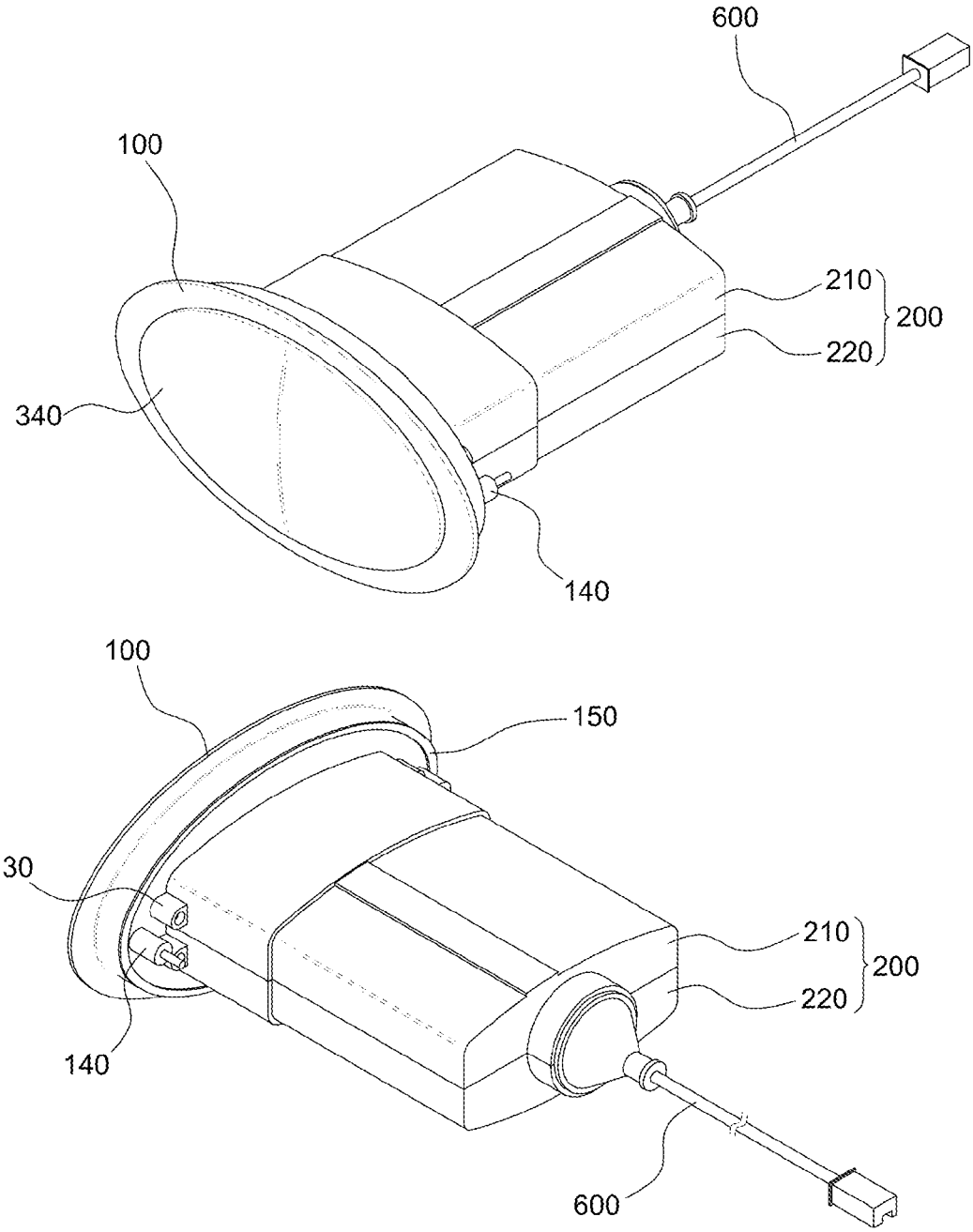
FIG. 3 is an assembled perspective view showing the exemplary draw-out handle of the tailgate in accordance with the present invention.
Figure 4:
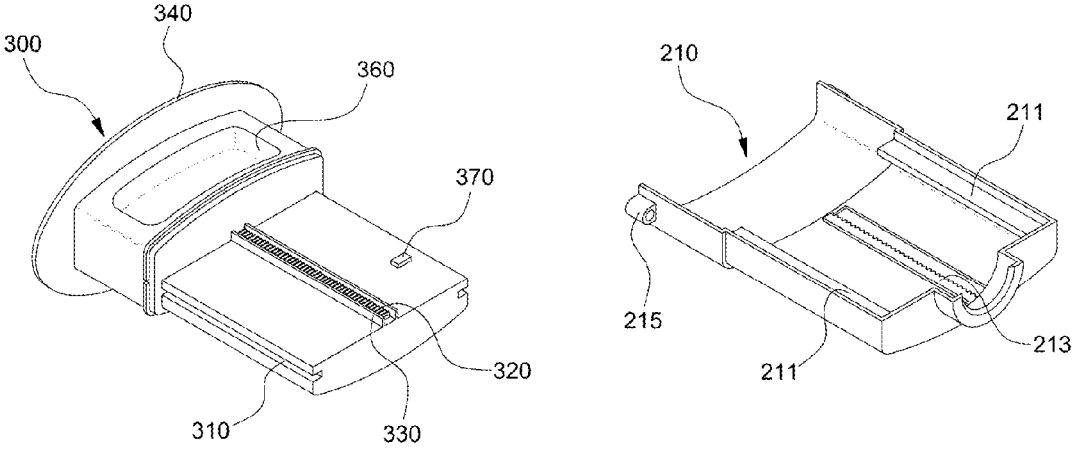
FIG. 4 is a perspective view showing a tailgate handle and an upper housing of FIG. 3.
Figure 5A:
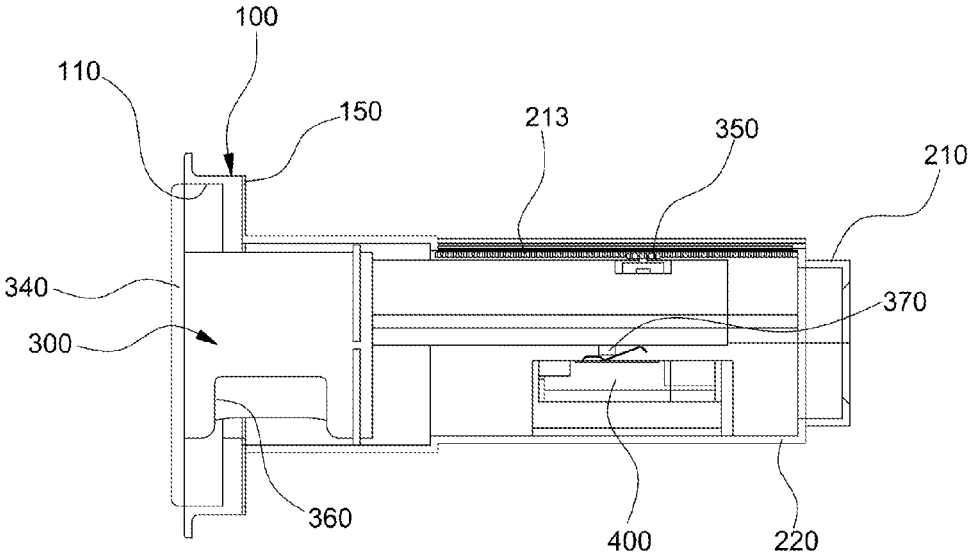
FIGS. 5A to 5C are cross-sectional views showing an exemplary operation for opening the tailgate in accordance with the present invention.
Figure 5B:
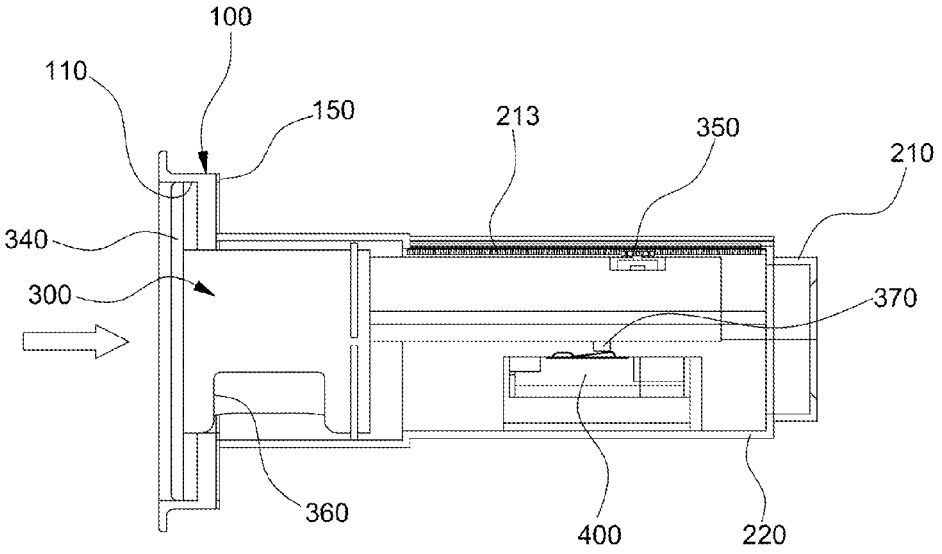
Figure 5C:
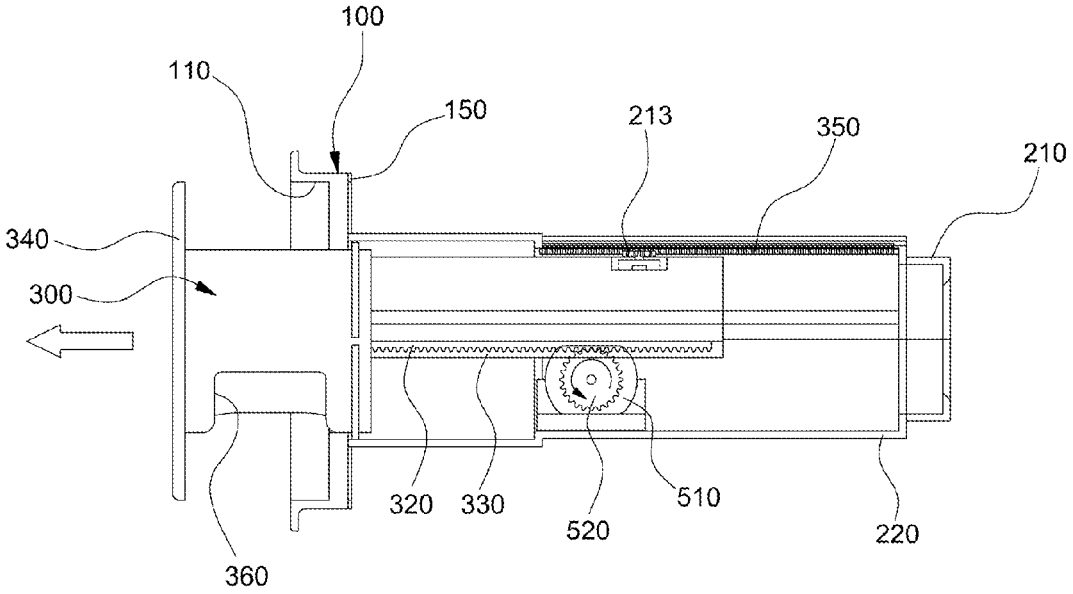
Figure 6:
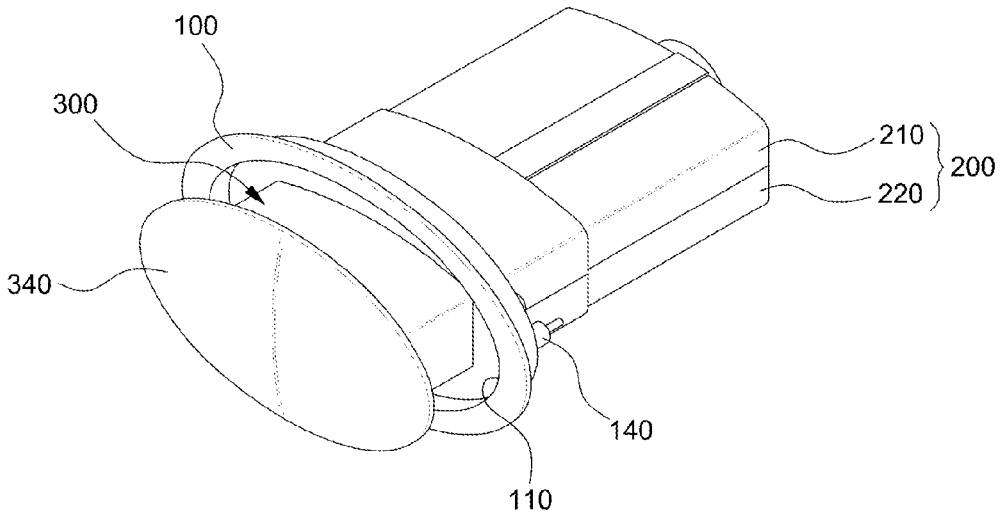
FIG. 6 is a perspective view showing the exemplary tailgate handle drawn out by the operation shown in FIGS. 5A to 5C.
Figure 7:
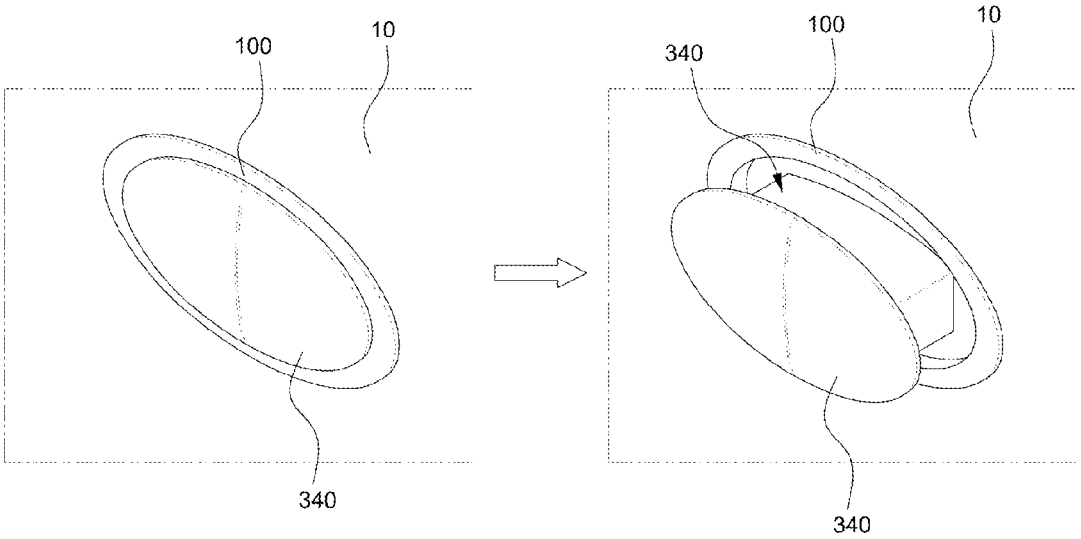
FIG. 7 is a diagram showing the operation for opening the tailgate in accordance with the present invention.

The assembly portion 130 and 140, as shown in FIG. 2A, for example, protrudes from the rear surface of the handle cover 100 and may be fixedly assembled with the outside panel and the housing 200 (for example, in such a manner that the assembly portion 140 is inserted into one side of the outside panel and, at the same time, a protruding portion of the outside panel is inserted into the assembly portion 140).

Moreover, a seal pad 150 for waterproofing and dust proofing is provided on the rear surface of the handle cover 100.

For example, the seal pad 150 may provide waterproof and dustproof functions between the outside handle of the tailgate and the outside panel, between the handle cover 100 and the housing 200, and between the handle cover 100 and the tailgate handle 300.

The housing 200 includes an upper housing 210 and a lower housing 220. A guide rail 211 for guiding sliding movement of the tailgate handle 300 is formed to project from the inner surface of the upper housing 210, and a gear rail 213 processed into a gear shape to match with a damper gear 351 of a damper 350 is formed to project from the lower surface of the upper housing 210.

A sliding groove 310 inserted into the guide rails 211 is formed on the side of the rear of the tailgate handle 300 such that the tailgate handle 300 slidably moves in the housing 200 while the sliding groove 310 is inserted into the guide rail 211.

The tailgate handle 300 penetrating the handle cover 100 is configured to be located inside the housing 200 and integrally formed with the logo portion 340 on the front thereof, which is exposed to the outside of the tailgate at all times and includes a logo of a manufacturer. One will appreciate that the tailgate handle may be monolithically formed with the logo portion.

That is, the tailgate handle 300 is pushed by a user, while the logo portion 340 is located inside the groove portion 110 of the handle cover 100, and is slidably inserted into the inside of the housing 200.

Moreover, the damper 350 for reducing the drawing-out and returning speed of the tailgate handle 300 is further provided on the top of the rear of the tailgate handle 300.

The damper 350 includes a damper housing 353 fixedly assembled on the top of the rear of the tailgate handle 300, a rotating shaft 355 penetrating the top of the damper housing 353 and rotatably connected to the damper housing 353, and the damper gear 351 fixedly connected to the rotating shaft 355, and the inside of the damper housing 353 is filled with a fluid such as oil.

During drawing-out and returning of the tailgate handle 300, the damper 350 reduces the movement speed of the tailgate handle 300 by the viscosity of the fluid filled in the damper housing 353 as the damper gear 351 matching with the gear rail 213 rotates.

Moreover, the outside handle of the present invention further includes a handle operation detection unit for detecting the operation of the pushed tailgate handle 300.

The handle operation detection unit includes the micro switch 400 closed by the pushed tailgate handle 300 and a wiring 600 for transmitting a handle operation signal to a body control module (BCM) when the micro switch 400 is closed.

The micro switch 400 is disposed on the lower housing 220 and includes the contact point 420 and a switch 410 for its operation. The micro switch 400 is closed when the switch 410 is pressed to be in contact with the contact point 420 and then inputs the handle operation signal to the BCM.

The micro switch 400 is located in a predetermined position such that the contact point 420 is closed by the tailgate handle 300 pushed to move to the front of the vehicle. To this end, a push button 370 is formed to project from the bottom of the tailgate handle 300.

The wiring 600 is mounted at the rear of the housing 200 to transmit the handle operation signal to the BCM when the micro switch 400 is closed.

Moreover, the wiring 600 is fixedly assembled to the rear of the upper housing 210 and the lower housing 200, which are disposed up and down and fixedly assembled with the handle cover 100.

Furthermore, the wiring 600 is connected to a power supply unit (not shown) for supplying power to the micro switch 400, the BCM, and a drive motor 510. If the handle operation signal transmitted when the micro switch 400 is closed is input to the BCM, power is applied to the motor unit 500 by the control of the BCM to operate the drive motor 510, thereby rotating a motor gear 520.

That is, the wiring 600 serves to transmit the handle operation signal to the BCM and supply the power to the motor unit 500 when the micro switch 400 is closed, and the BCM serves to draw out the tailgate handle 300 and unlock the latch unit when the handle operation signal of the handle operation detection unit is received.

When a user pushes the tailgate handle 300, the push button 370 is moved to the front of the vehicle by the movement of the tailgate handle 300 to press the micro switch 400, thereby closing the contact point 420.

Moreover, the motor unit 500 is fixedly installed in a predetermined position of the lower housing 220.

The motor unit 500 is configured to move the tailgate handle 300 to be drawn out and returned inside the housing 200 and includes the drive motor 510 and the motor gear 520 axially connected to the drive motor 510.

The drive motor 510 generates power for drawing out and returning the tailgate handle 300, and the motor gear 520 serves to transmit the power of the drive motor 510 to the tailgate handle 300.

To achieve this, a handle gear rail 320 and a pair of gear guardrails 330 are formed at the bottom of the tailgate handle 300 to extend in the longitudinal direction of the vehicle.

The handle gear rail 320 is formed into a gear shape to match with the motor gear 520, and the gear guardrails 330 are spaced from each other and disposed on both sides of the handle gear rail 320.

A rotating shaft of the drive motor 510 is placed on the gear guardrails 330, and a portion of the motor gear 520 is inserted between the spaced gear guardrails 330.

That is, when the tailgate handle 300 is moved by the rotation of the motor gear 520, the gear guardrails 330 support the motor gear 520 to be located on the handle gear rail 320 (or such that the motor gear 520 and the handle gear rail 320 are maintained engaged with each other).

The motor gear 520 may be configured as a spur gear, for example.

Moreover, when the tailgate handle 300 is sufficiently drawn out to the rear of the vehicle as the motor gear 520 rotates, the user grips the tailgate handle 300 by hand to open the tailgate.

For this purpose, a handle groove 360 having a concave shape is formed at the bottom of the tailgate handle 300 such that the user grips the tailgate handle 300 using the handle groove 360 and raises the tailgate.

Meanwhile, an upper connection portion 215 and a lower connection portion 225 inserted into the assembly portion 130 of the handle cover 100 are provided on the upper housing 210 and the lower housing 220, respectively.

Next, the operation of the draw-out handle of the tailgate according to various embodiments of the present invention will be described.

First, when the user slightly pushes the logo portion 340 to open the tailgate, the contact point 420 of the micro switch 400 inside the housing 200 is closed by the tailgate handle 300 moving to the front of the vehicle, and the handle operation signal is transmitted to the BCM.

The BCM supplied with the handle operation signal by the micro switch 400 applies power to the motor unit 500 connected to the tailgate handle 300, and the tailgate handle 300 is drawn out to the rear of the vehicle by the operation of the drive motor 510. At the same time, the BCM unlocks the latch unit.

When the handle groove 360 is completely exposed after the tailgate handle 300 is drawn out, the user grips the tailgate handle 300 using the handle groove 360 and raises the tailgate, thereby opening the tailgate.

Meanwhile, when the user pulls down the tailgate to close it, a terminal of a wiring harness (not shown) connected to the BCM is contacted and closed, and a locking signal of the latch unit is transmitted to the BCM. After the BCM receives the locking signal of the latch unit, the BCM operates the drive motor 510 to retract the tailgate handle 300 in the rear of the vehicle (or to a close position).

As described above, according to the draw-out handle of the tailgate of the present invention, the user grips the tailgate handle drawn out by the operation of the motor unit and opens the tailgate, and thus it is possible to simply open the tailgate. Moreover, only the logo portion of the tailgate handle is exposed at the usual time (i.e., when the tailgate handle is not drawn out), and thus the appearance is improved, which increases marketability.

Moreover, according to the present invention, since the logo of the manufacturer is exposed when the tailgate is opened and closed, the logo is prominently shown, which increases awareness of the manufacturer.

For convenience in explanation and accurate definition in the appended claims, the terms "upper" or "lower", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An exterior draw-out handle assembly of a tailgate, comprising:

a slidably movable tailgate handle;

a motor unit moving the tailgate handle between a drawn out position extending outwardly from the tailgate and a returned position within the tailgate;

a handle operation detection unit detecting the operation of the tailgate handle pushed by a user and transmitting a handle operation signal to a body control module (BCM) controlling the motor unit for drawing out the tailgate handle to extend outwardly from the tailgate and, at the same time, unlocking a latch unit when receiving the handle operation signal of the handle operation detection unit; and a housing into which the tailgate handle extends;

wherein the housing comprises an upper housing and a lower housing, the upper housing including a guide rail for guiding movement of the tailgate handle;

wherein the tailgate handle further comprises a handle gear rail provided at a bottom of the tailgate handle and having a rack cooperating with a motor gear of the motor unit;

wherein a handle groove having a concave shape is formed at a bottom of the tailgate handle such that a user grips the tailgate handle using the handle groove and raises the tailgate; and wherein when the tailgate is lowered to be closed, the handle groove is configured to be inserted into the housing together with the tailgate handle, and when the tailgate handle is pushed, the BCM controls the motor unit to move the handle groove of the tailgate handle to extend out from the housing together with the tailgate handle; and wherein when the tailgate is lowered to close and the BCM receives a closing signal of the tailgate transmitted from a contact point connected to the BCM, the BCM controls the motor unit to retract the handle groove of the tailgate handle into the housing together with the tailgate handle.

2. The draw-out handle assembly of claim 1, further comprising:

a handle casing assembled to the housing and fixedly installed on an outside panel of the tailgate.

3. The draw-out handle assembly of claim 1, wherein the handle operation detection unit comprises a micro switch closed by the pushed tailgate handle and a wiring for transmitting the handle operation signal to the BCM when the micro switch is closed.

4. The draw-out handle assembly of claim 1, wherein the tailgate handle further comprises a damper engaged with the gear rail for reducing the drawing-out and returning speed of the tailgate handle.

5. The draw-out handle assembly of claim 1, wherein the tailgate handle further comprises a pair of gear guardrails provided at both lateral sides of the handle gear rail at the bottom of the tailgate handle to support the motor gear between the gear guardrails to be located on the handle gear rail.

6. The draw-out handle assembly of claim 1, wherein the tailgate handle further comprises a logo portion integrally formed with a logo of a manufacturer on the front of tailgate handle.

7. The draw-out handle assembly of claim 1, wherein the tailgate handle further comprises a logo portion monolithically formed with a logo of a manufacturer on the front of tailgate handle.

8. An exterior draw-out handle assembly of a tailgate, comprising:

a slidably movable tailgate handle;

a motor unit moving the tailgate handle between a drawn out position extending outwardly from the tailgate and a returned position within the tailgate;

a handle operation detection unit detecting the operation of the tailgate handle pushed by a user and transmitting a handle operation signal to a body control module (BCM) controlling the motor unit for drawing out the tailgate handle to extend outwardly from the tailgate and, at the same time, unlocking a latch unit when receiving the handle operation signal of the handle operation detection unit; and a housing into which the tailgate handle extends;

wherein the housing comprises an upper housing and a lower housing, the upper housing including a guide rail for guiding movement of the tailgate handle;

wherein the tailgate handle further comprises a handle gear rail provided at a bottom of the tailgate handle and having a rack cooperating with a motor gear of the motor unit, wherein a handle groove having a concave shape is formed at a bottom of the tailgate handle such that a user grips the tailgate handle using the handle groove and raises the tailgate, wherein when the tailgate is lowered to be closed, the handle groove is configured to be inserted into the housing together with the tailgate handle, and when the tailgate handle is pushed, the BCM controls the motor unit to move the handle groove of the tailgate handle to extend out from the housing together with the tailgate handle, and wherein the tailgate handle further comprises a pair of gear guardrails provided at both lateral sides of the handle gear rail at the bottom of the tailgate handle to support the motor gear between the gear guardrails to be located on the handle gear rail.

9. The draw-out handle assembly of claim 8, wherein when the tailgate is lowered to close and the BCM receives a closing signal of the tailgate detected from a contact point connected to the BCM, the BCM controls the motor unit to retract the handle groove of the tailgate handle into the housing together with the tailgate handle.

10. The draw-out handle assembly of claim 8, further comprising:

a handle casing assembled to the housing and fixedly installed on an outside panel of the tailgate.

11. The draw-out handle assembly of claim 8, wherein the handle operation detection unit comprises a micro switch closed by the pushed tailgate handle and a wiring for transmitting the handle operation signal to the BCM when the micro switch is closed.

12. The draw-out handle assembly of claim 8, wherein the tailgate handle further comprises a damper engaged with the gear rail for reducing the drawing-out and returning speed of the tailgate handle.

13. The draw-out handle assembly of claim 8, wherein the tailgate handle further comprises a logo portion integrally formed with a logo of a manufacturer on the front of tailgate handle.

14. The draw-out handle assembly of claim 8, wherein the tailgate handle further comprises a logo portion monolithically formed with a logo of a manufacturer on the front of tailgate handle.

* * * * *